US007100653B2

(12) United States Patent
Lin

(10) Patent No.: US 7,100,653 B2
(45) Date of Patent: Sep. 5, 2006

(54) ANGLE ADJUSTABLE SAWING TABLE

(75) Inventor: Kun-Meng Lin, Changhua Hsien (TW)

(73) Assignees: Qualipro Enterprise Co., Ltd., Changhua Hsien (TW); Nedful Products Co., Ltd., Taichung (TW); T C L Supplies Ltd., Brighton (GB)

( * ) Notice: Subject to any disclaimer, the term of this patent is extended or adjusted under 35 U.S.C. 154(b) by 62 days.

(21) Appl. No.: 10/912,217

(22) Filed: Aug. 6, 2004

(65) Prior Publication Data

US 2006/0027289 A1 Feb. 9, 2006

(51) Int. Cl.
*B25H 1/02* (2006.01)
*B26D 1/14* (2006.01)

(52) U.S. Cl. ..... 144/286.5; 83/477.2; 83/574

(58) Field of Classification Search ..... 144/286.1–287, 144/144.1, 144.51, 144.52; 83/574, 447.2, 83/468.3, 468.4, 827, 828
See application file for complete search history.

(56) References Cited

U.S. PATENT DOCUMENTS

| | | | | | |
|---|---|---|---|---|---|
| 4,320,678 | A | * | 3/1982 | Volk | 83/574 |
| 4,350,066 | A | * | 9/1982 | Volk | 83/763 |
| 4,378,716 | A | * | 4/1983 | Volk | 83/438 |
| 4,489,634 | A | * | 12/1984 | Volk | 83/522.28 |
| 4,920,845 | A | * | 5/1990 | Blanchette | 83/574 |
| 5,090,283 | A | * | 2/1992 | Noble | 83/467.1 |

FOREIGN PATENT DOCUMENTS

DE 0283553 * 9/1987

* cited by examiner

*Primary Examiner*—Derris H. Banks
*Assistant Examiner*—Shelley Self
(74) *Attorney, Agent, or Firm*—Rabin & Berdo, P.C.

(57) ABSTRACT

An angle adjustable sawing table adapted to allow the installation of a circular saw. Wood material is placed at pre-set geometric angles. One end of a gage is placed on a table, and another end of the gage is flush against a measurement member for adjustment to a preset angle.

4 Claims, 23 Drawing Sheets

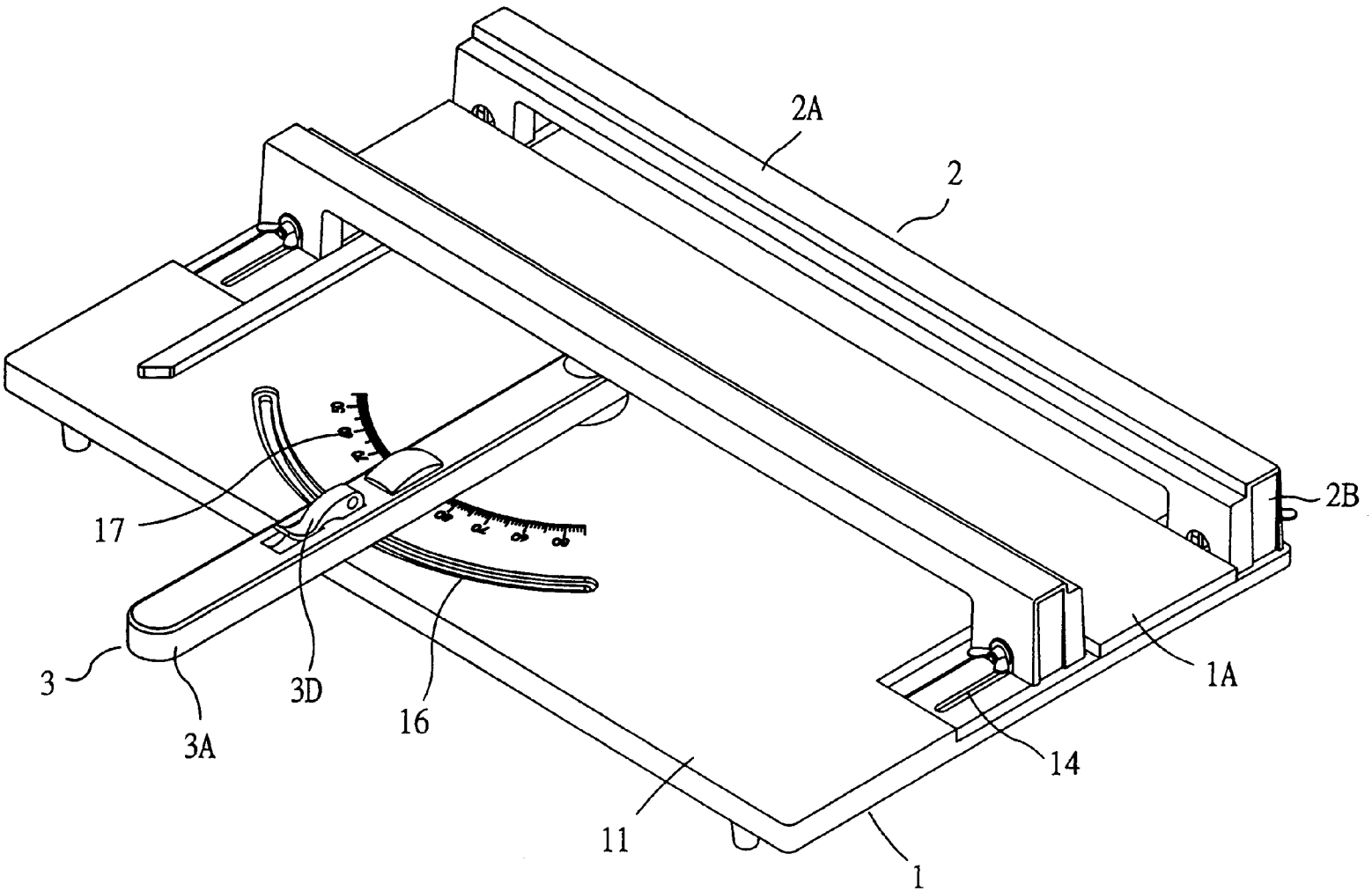
FIG. 1-A

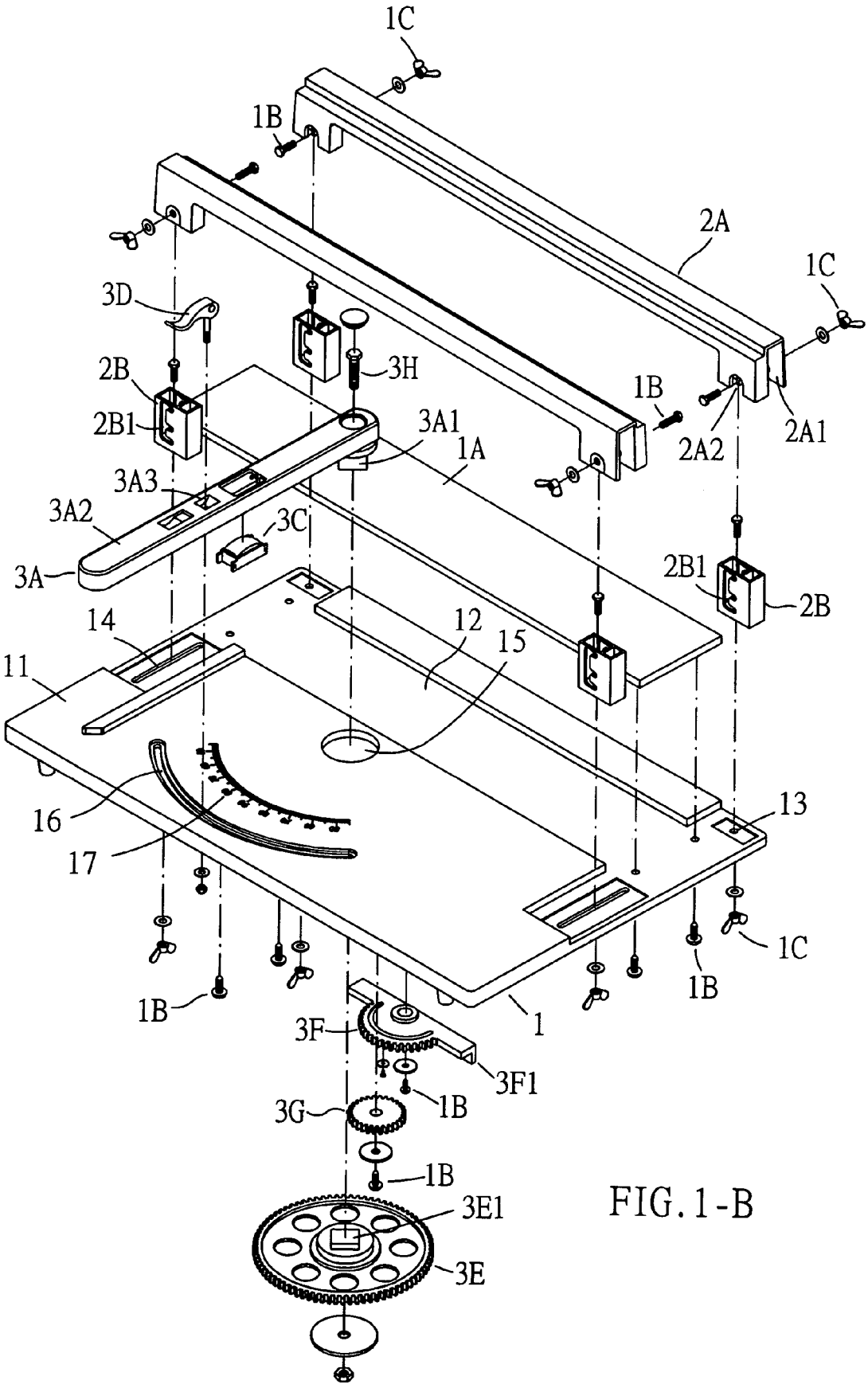
FIG. 1-B

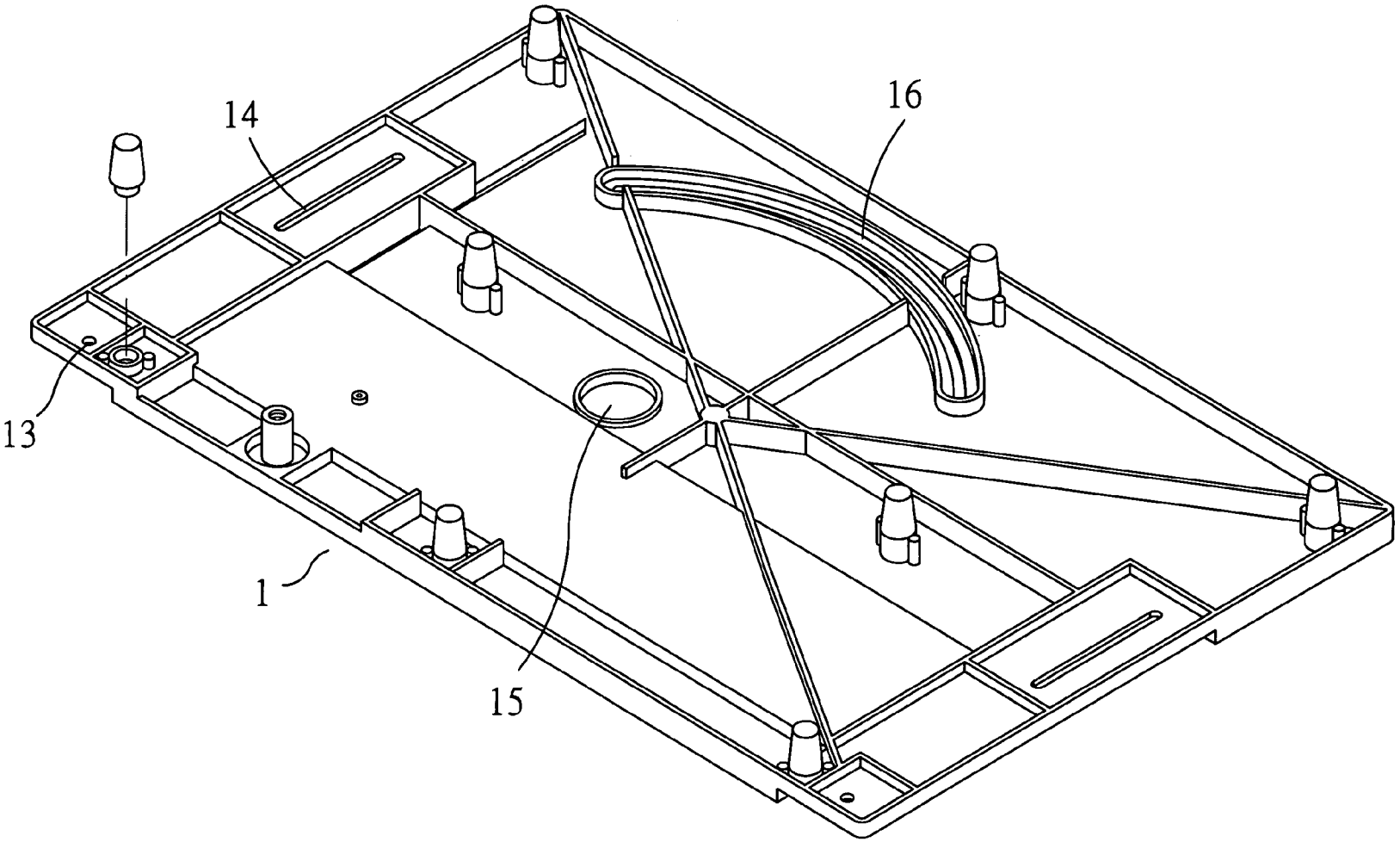
FIG. 1-C

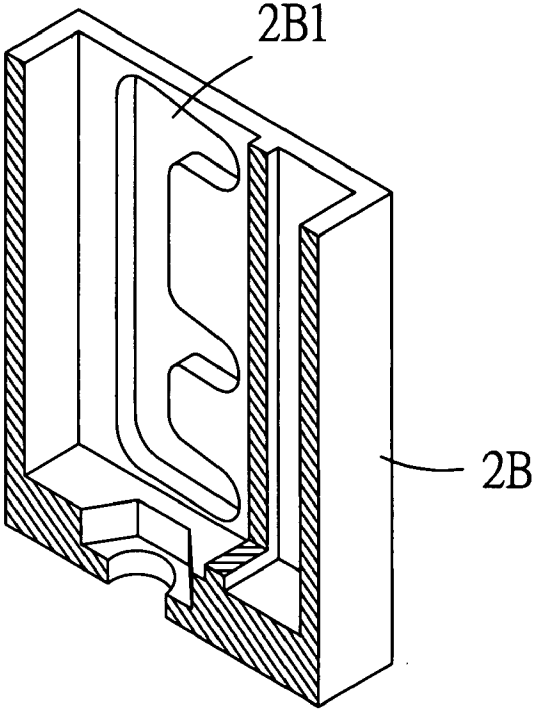
FIG. 2-B
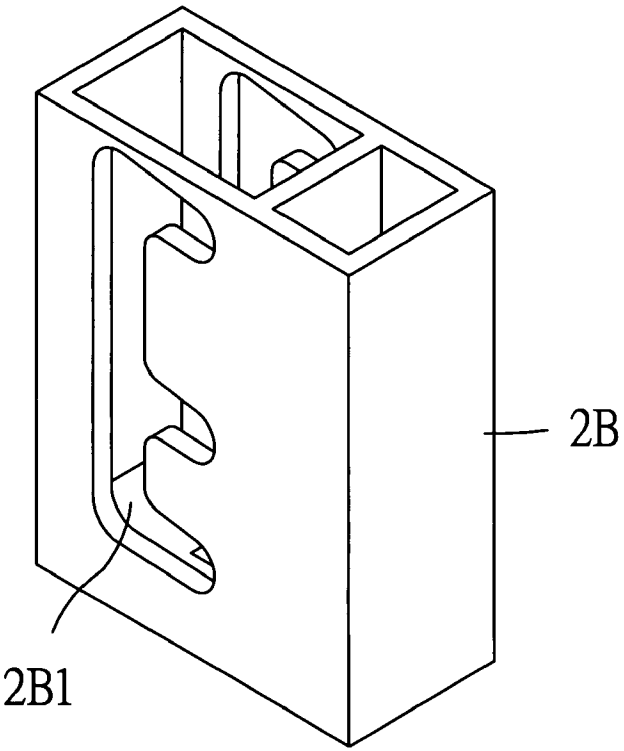
FIG. 2-A

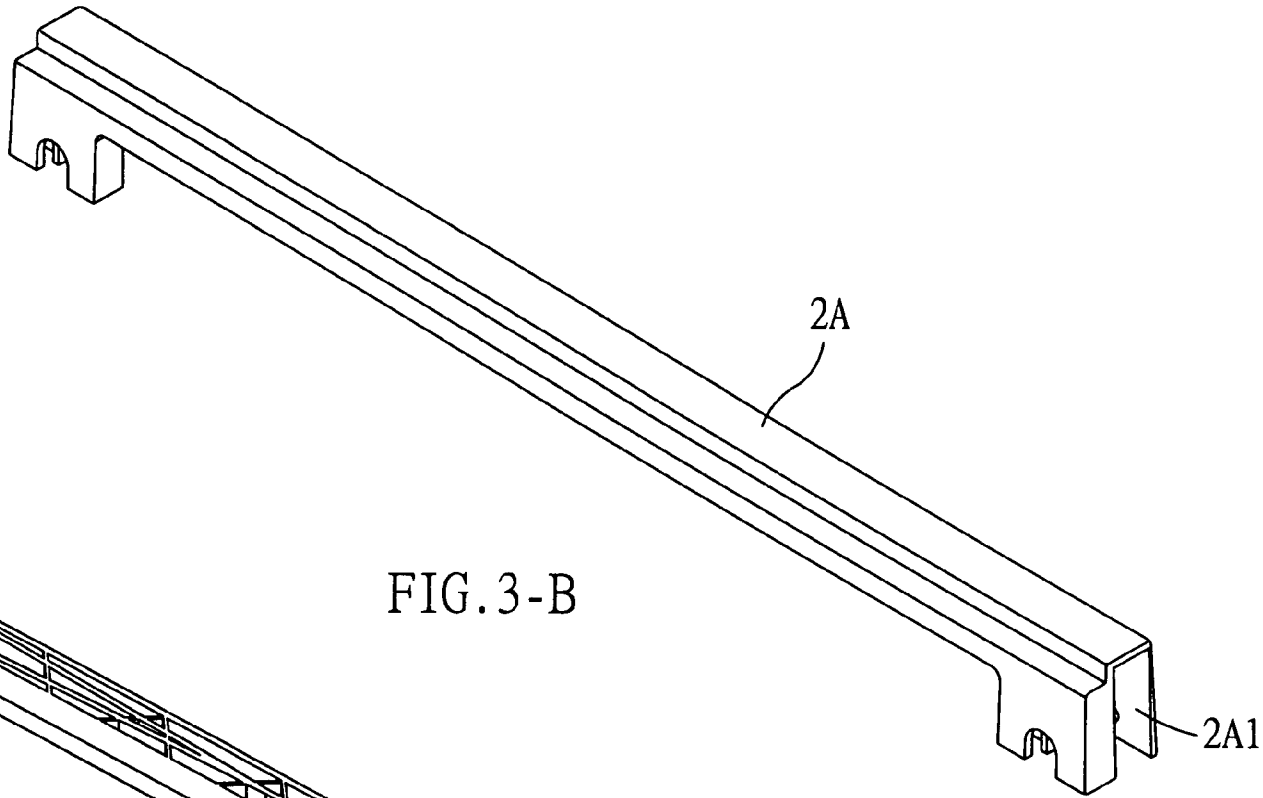
FIG. 3-B
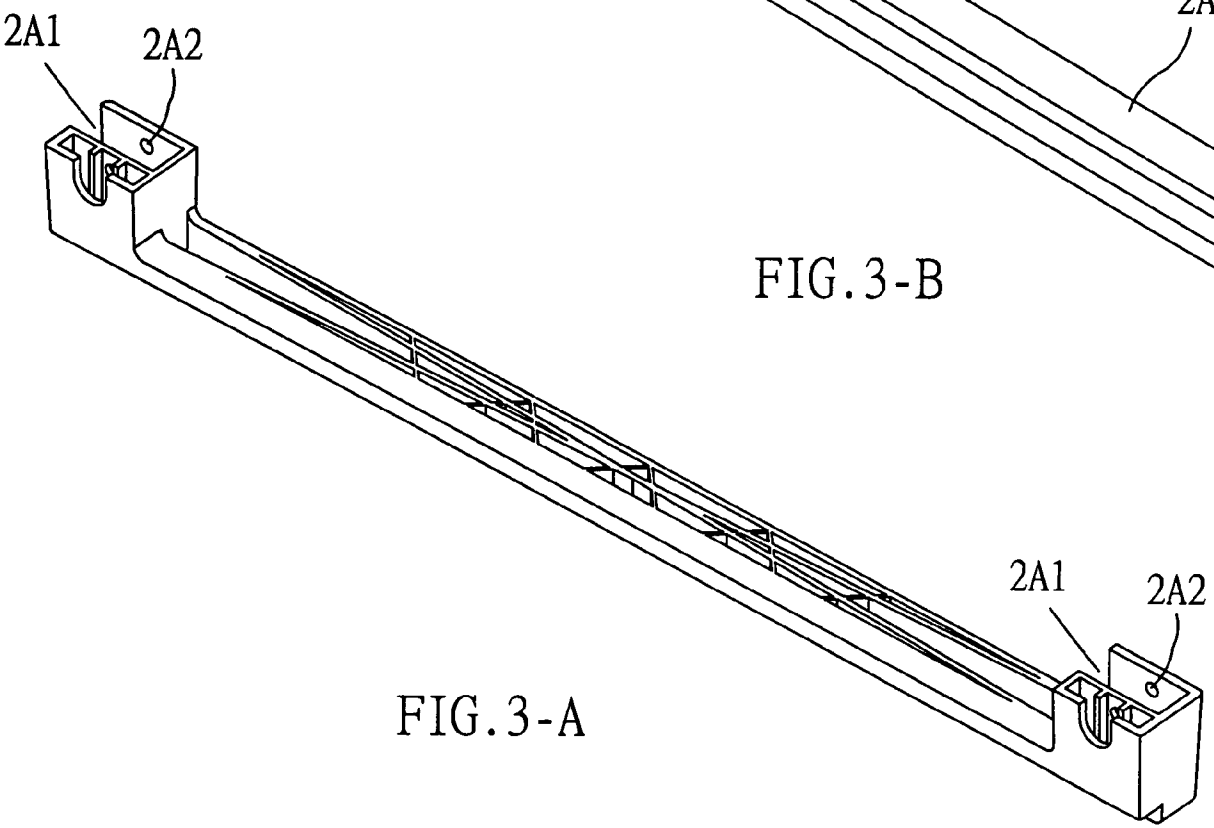
FIG. 3-A

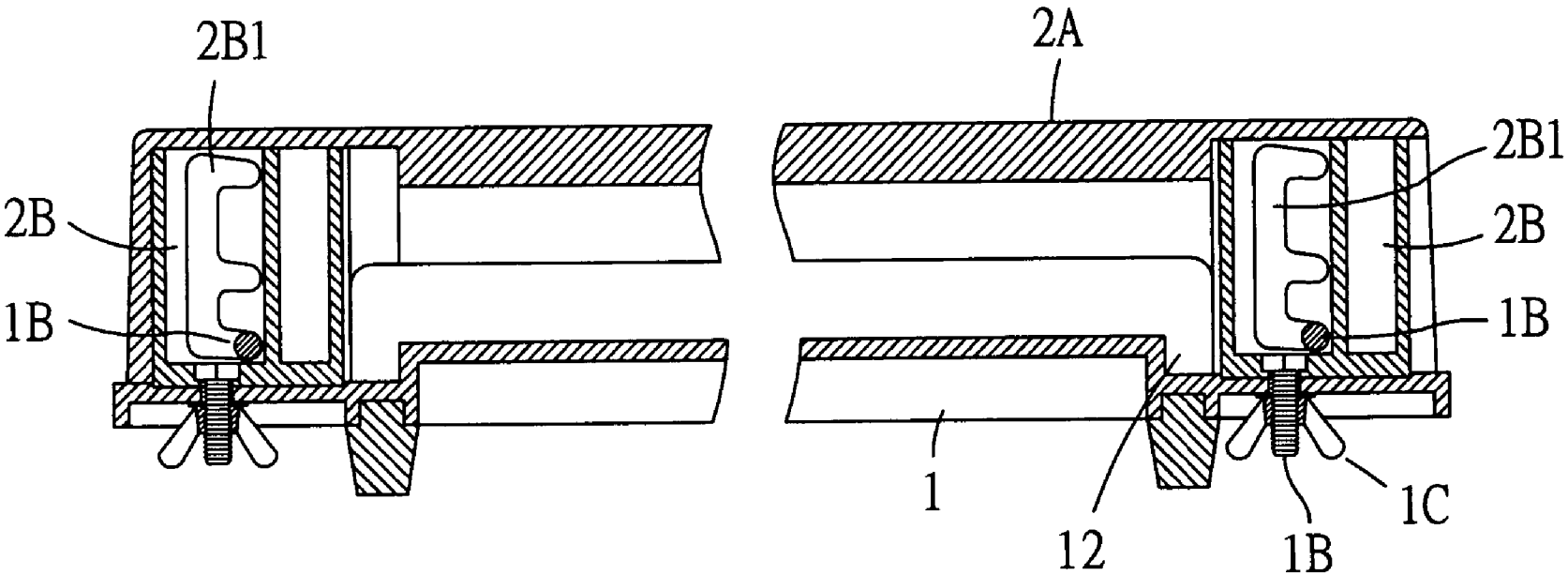
FIG. 4-A

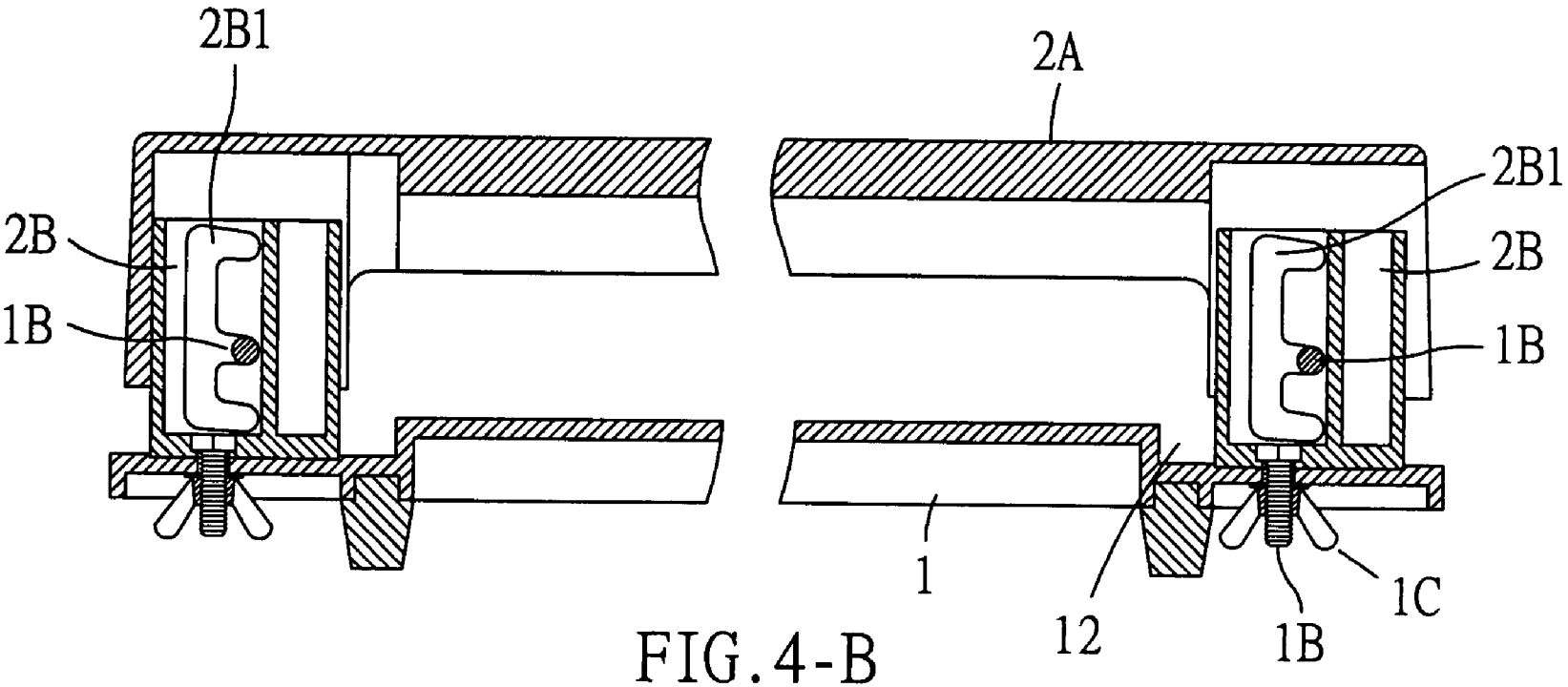
FIG. 4-B

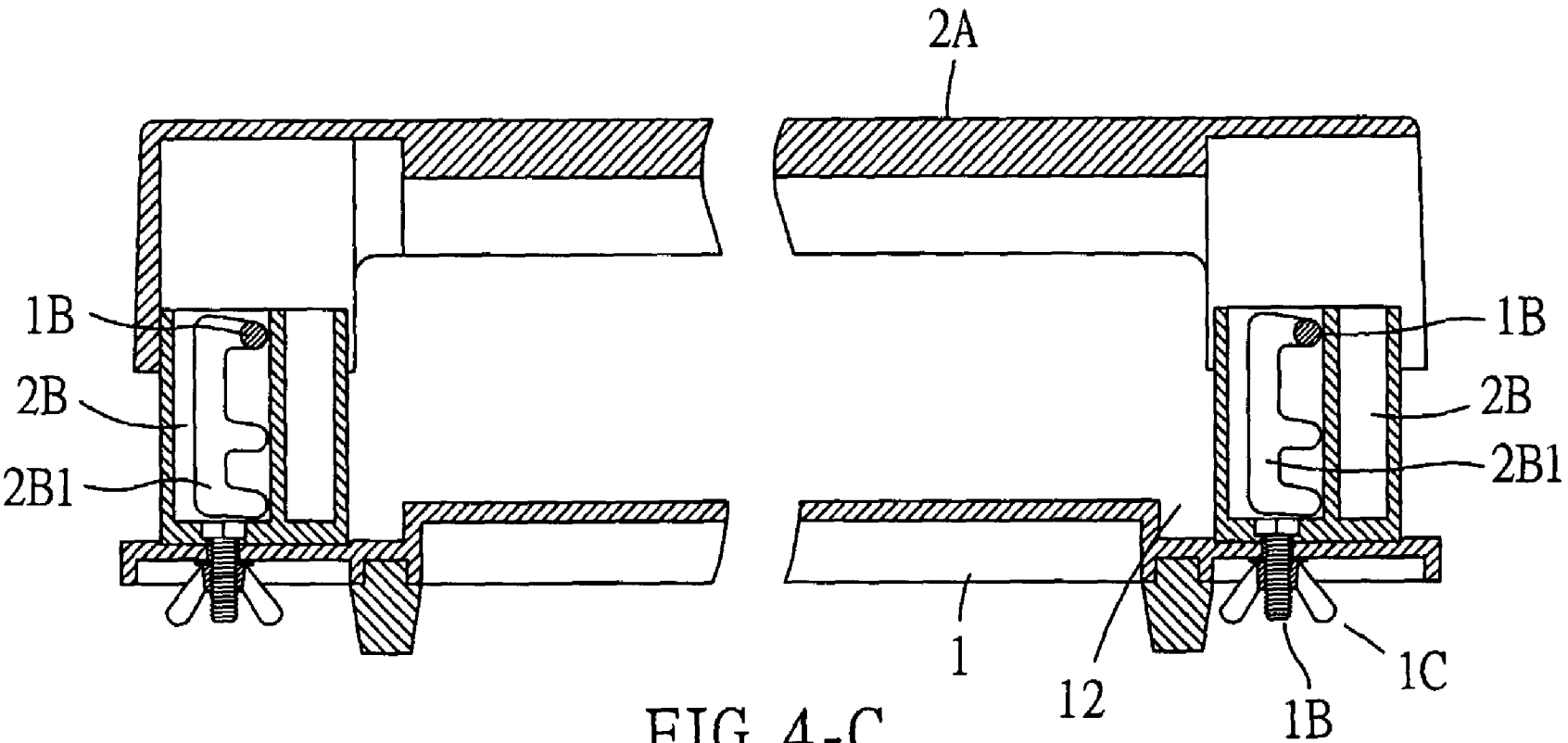
FIG. 4-C

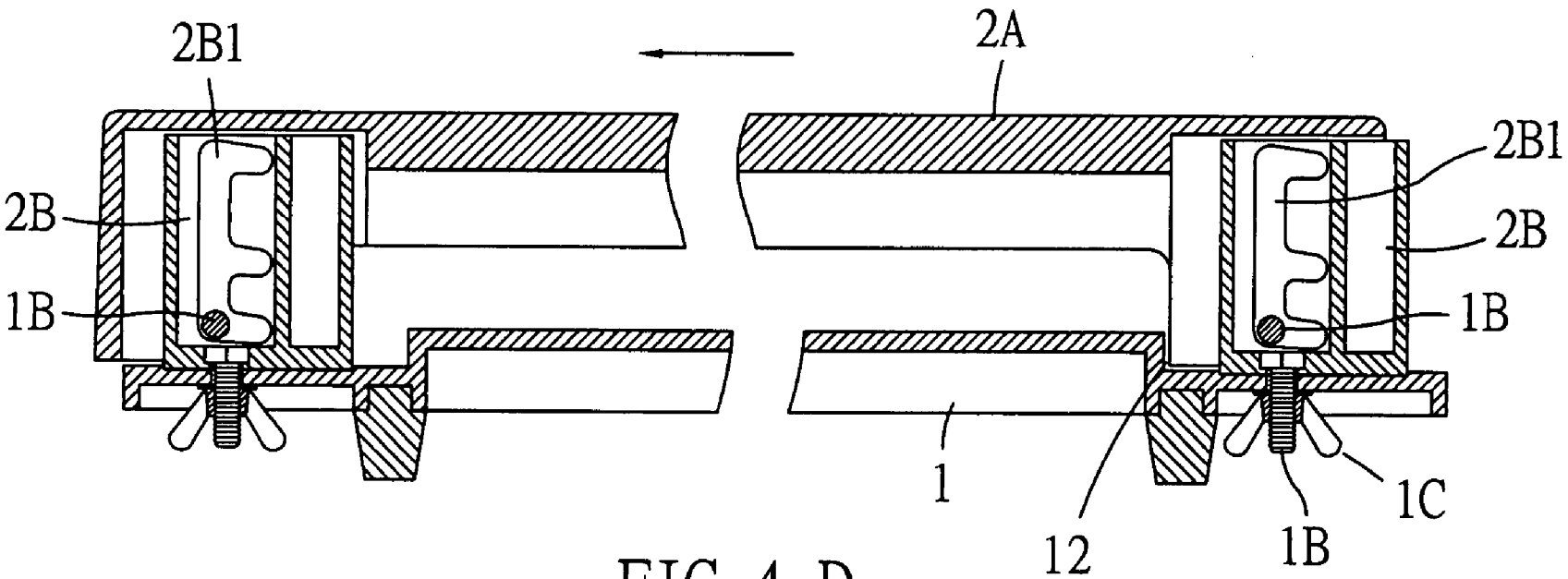
FIG. 4-D

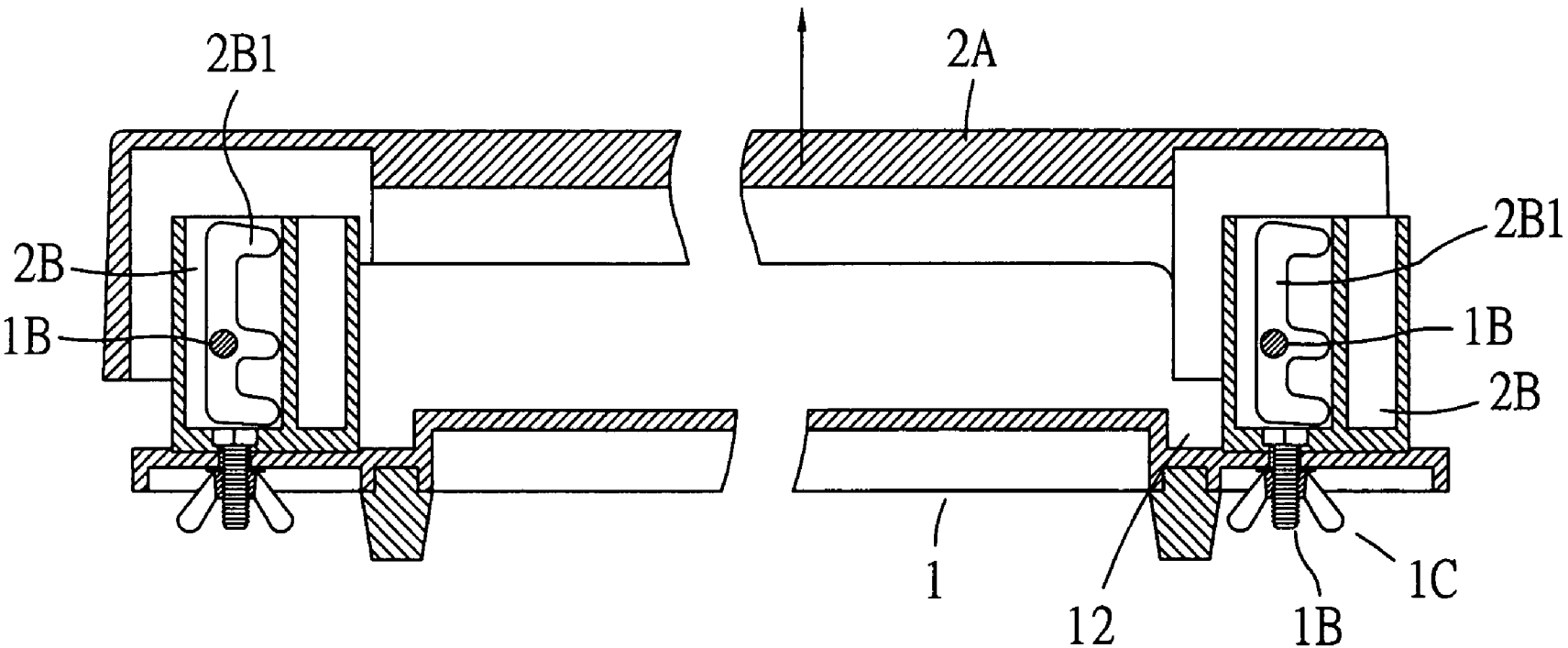
FIG. 4-E

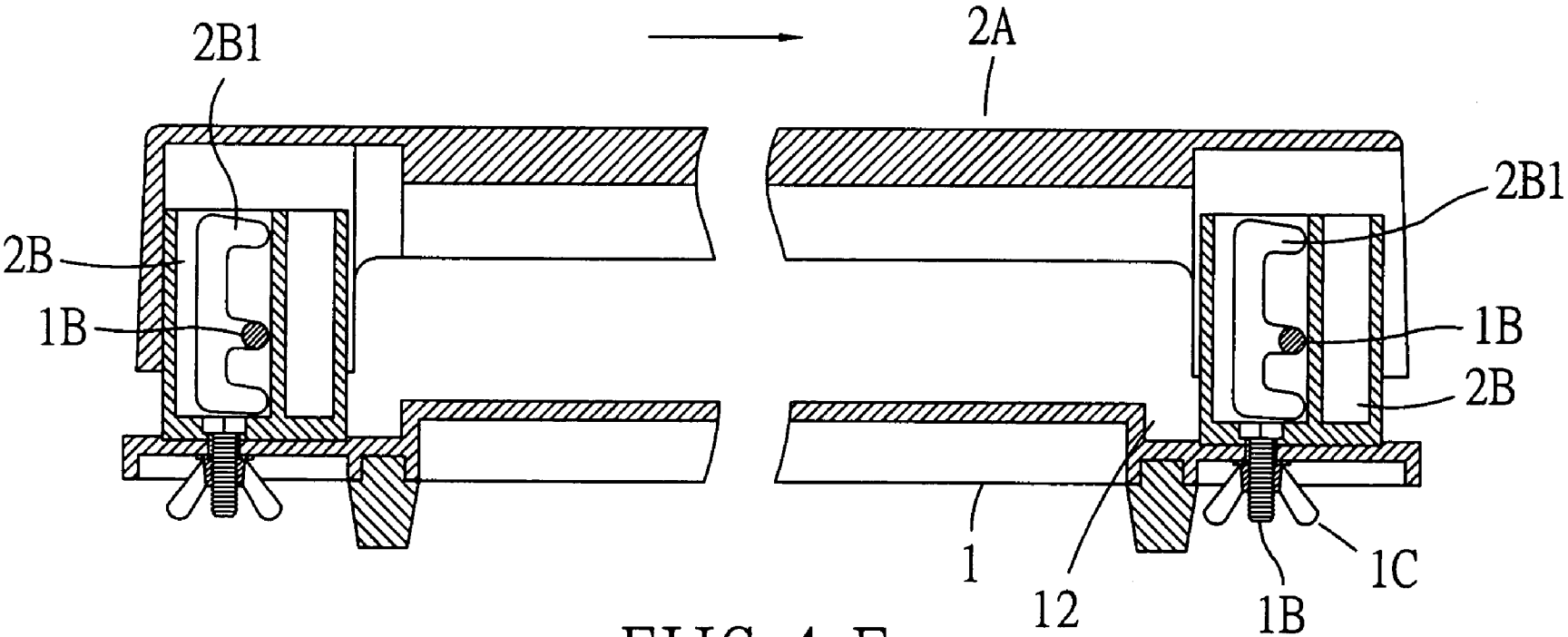
FIG. 4-F

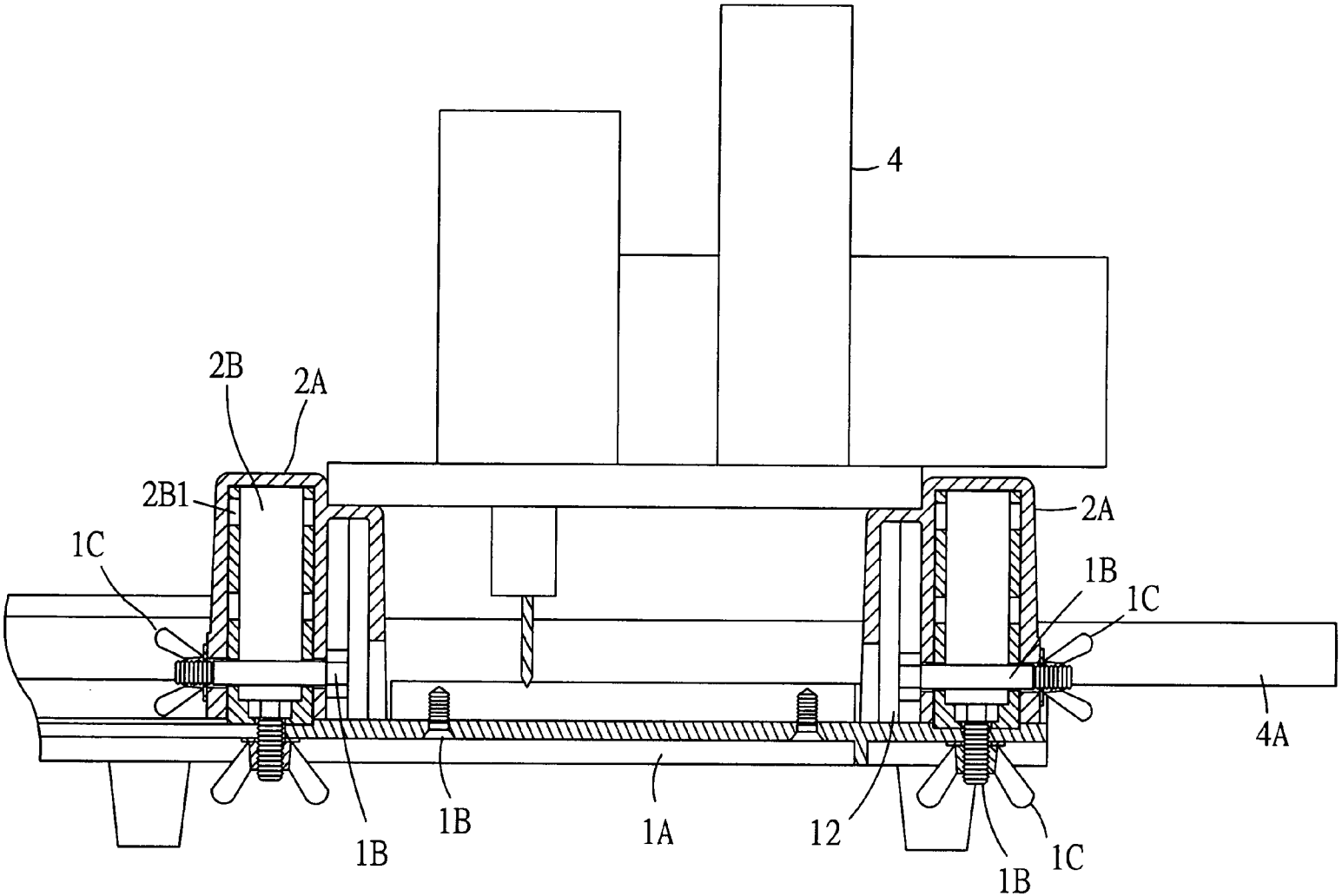
FIG. 4-G

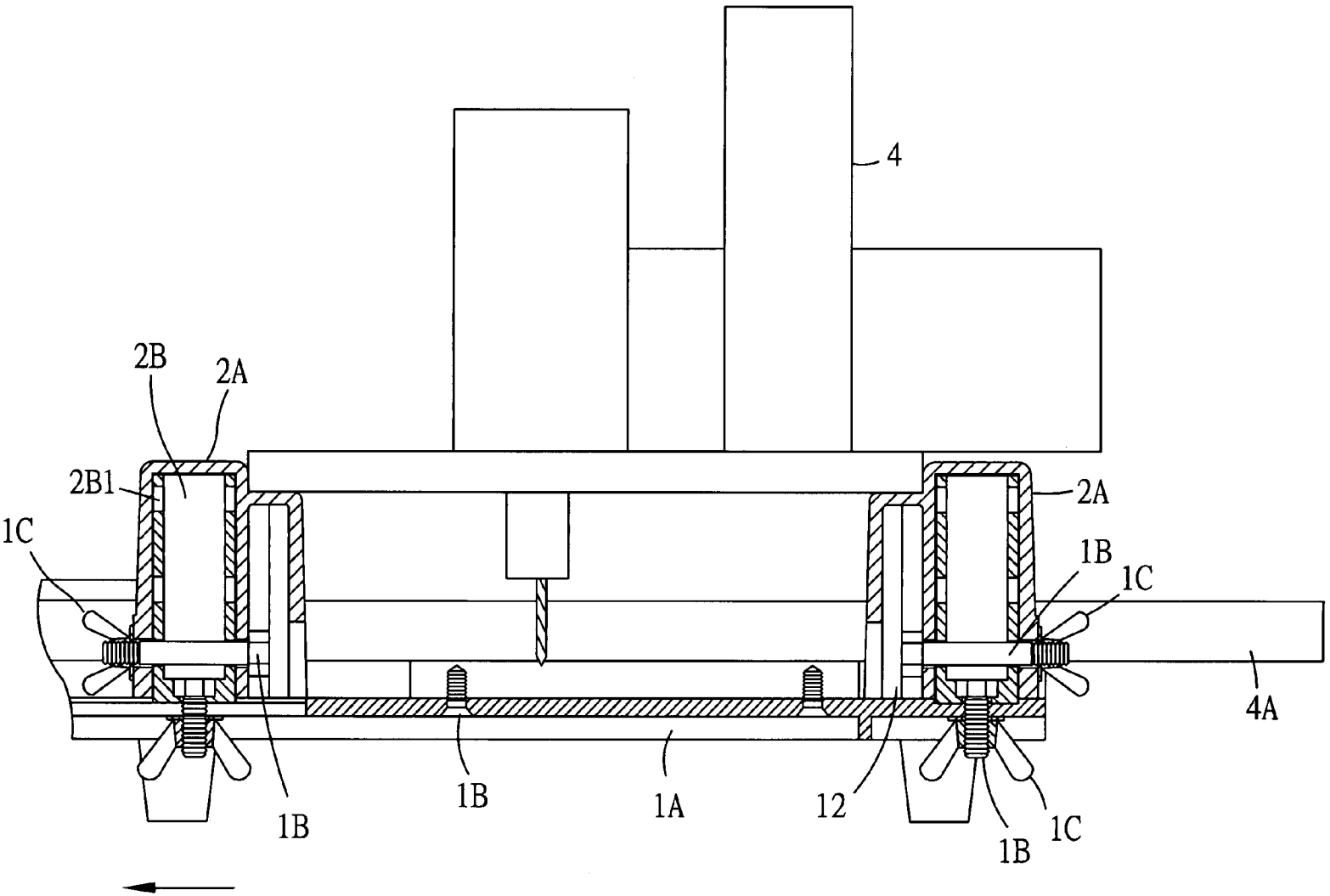
FIG.4-H

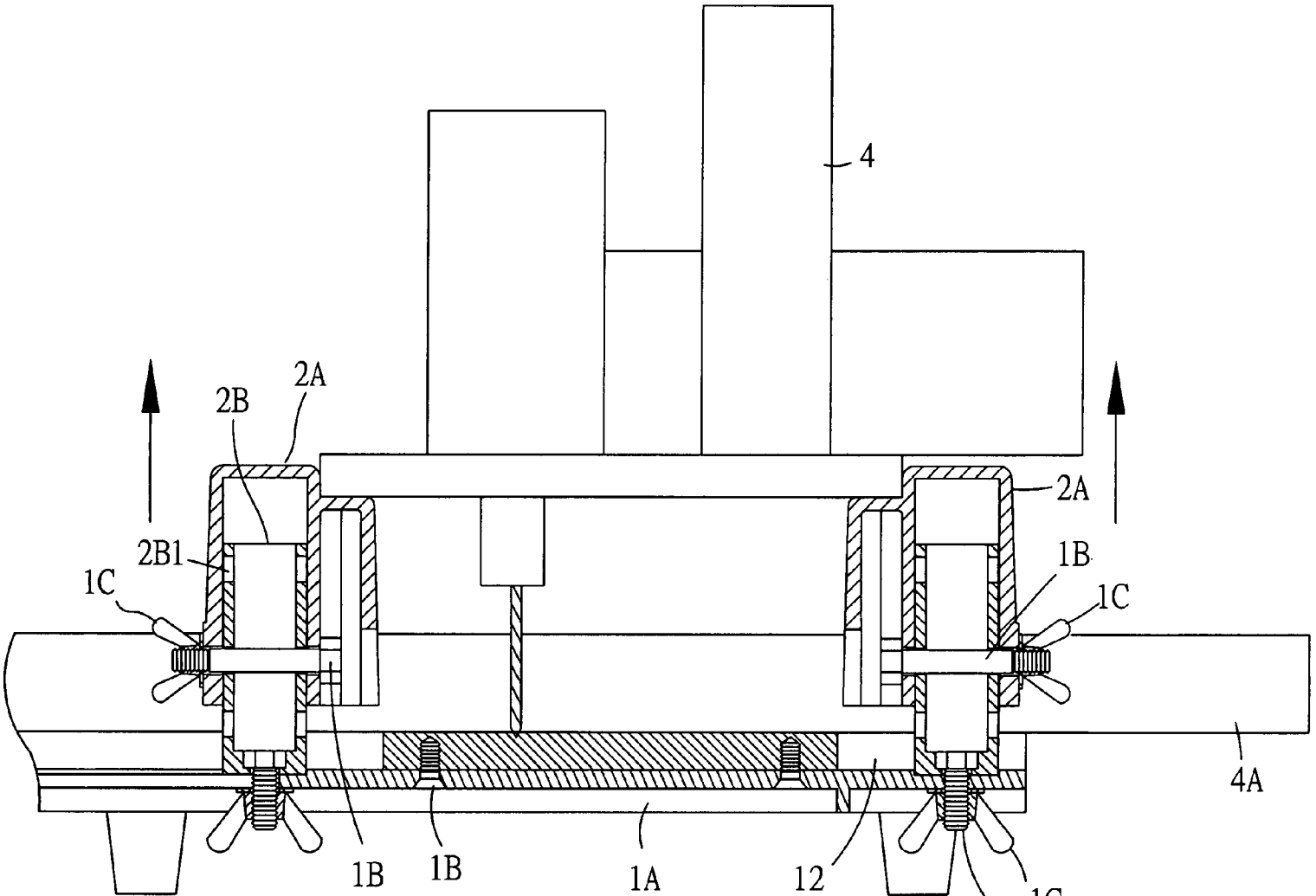
FIG. 4-I

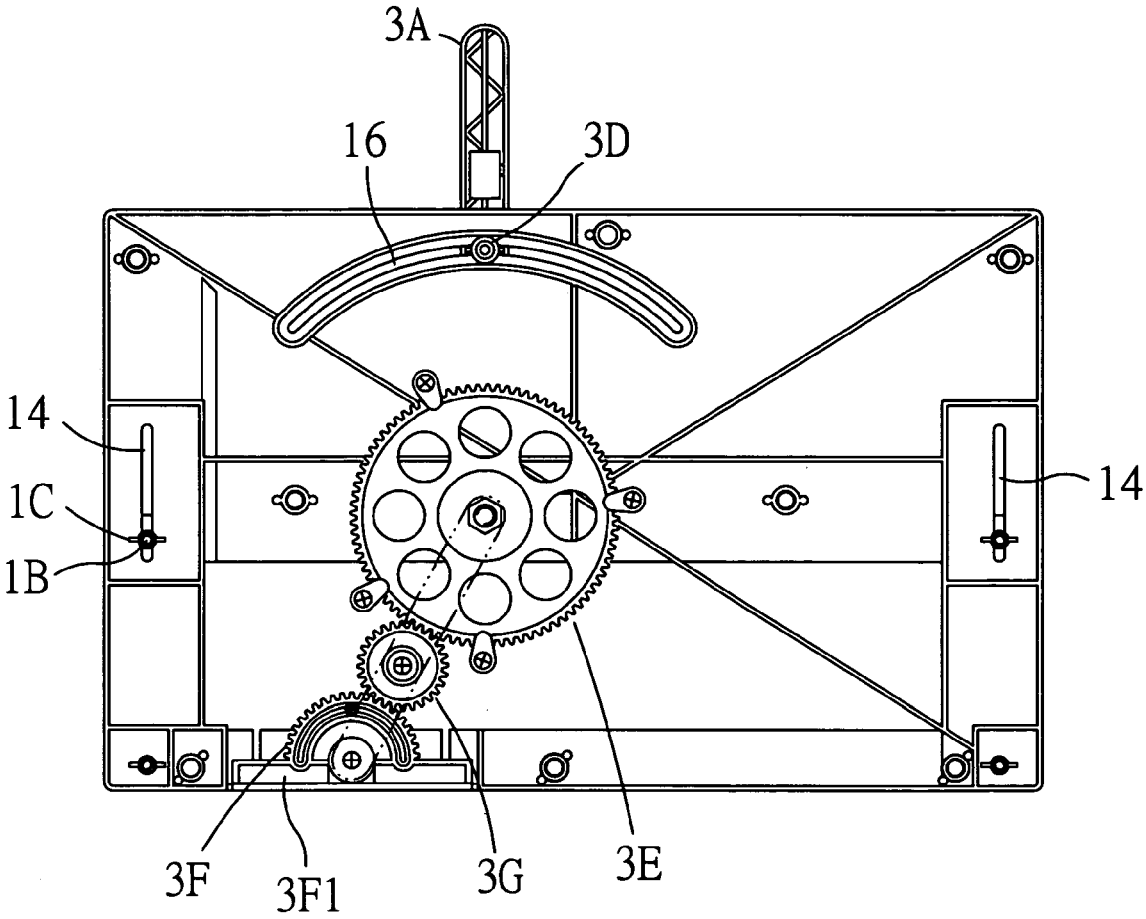
FIG.5-A

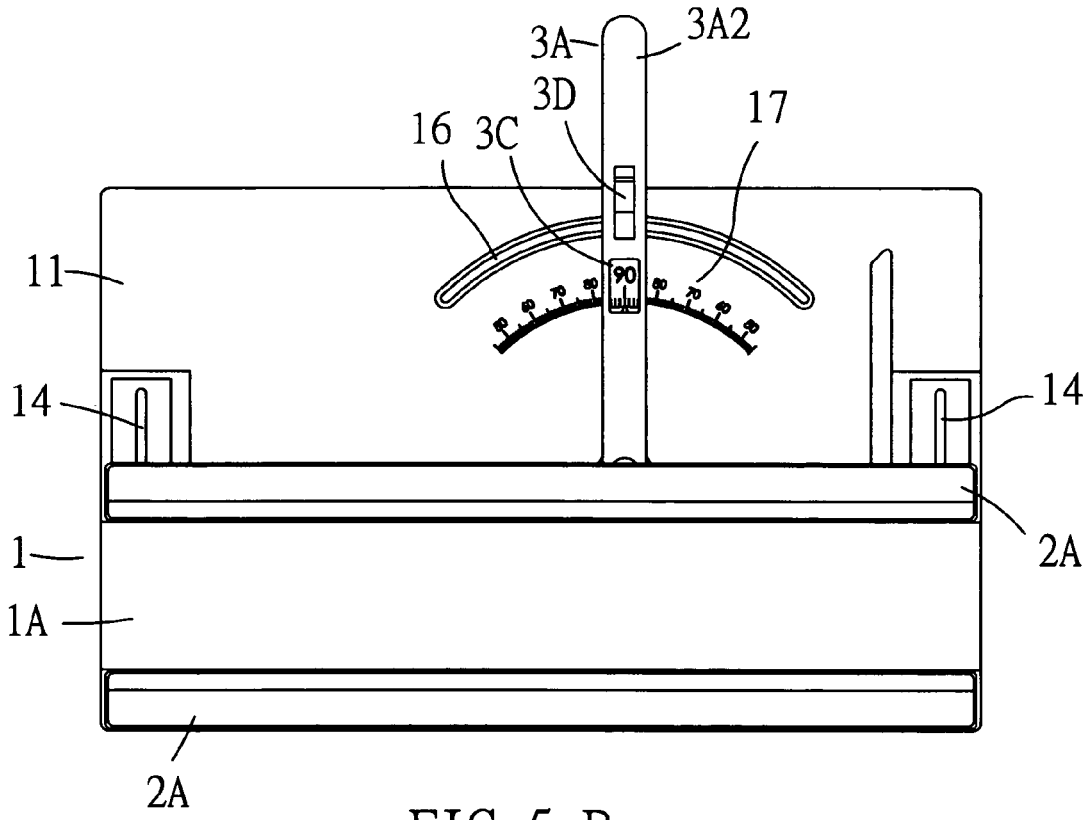
FIG.5-B

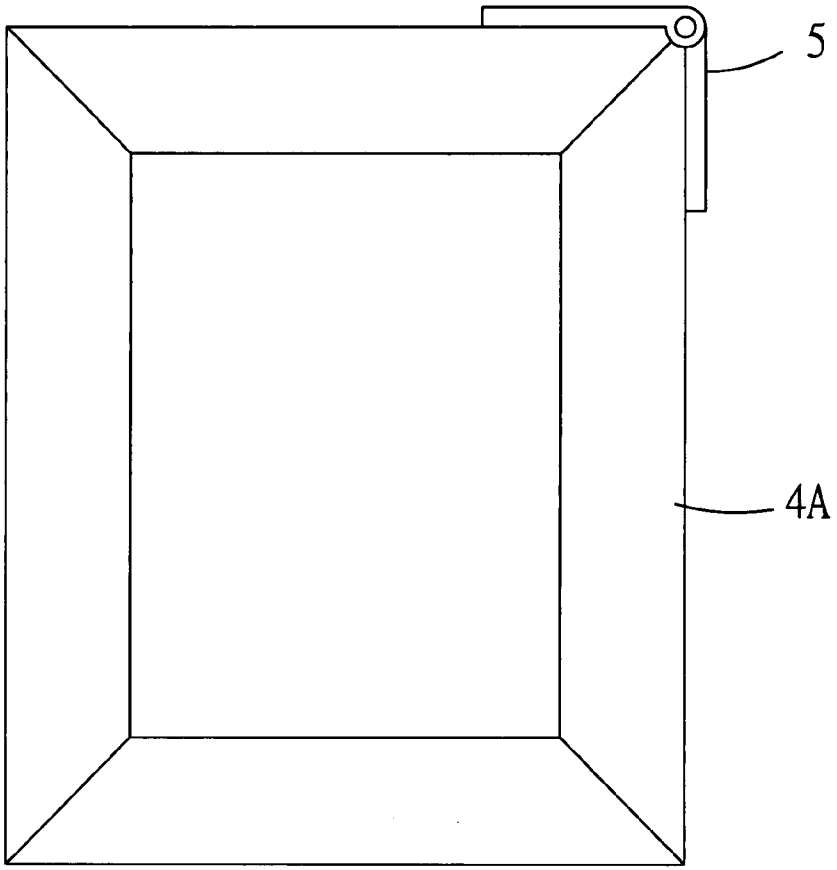
FIG. 6-A

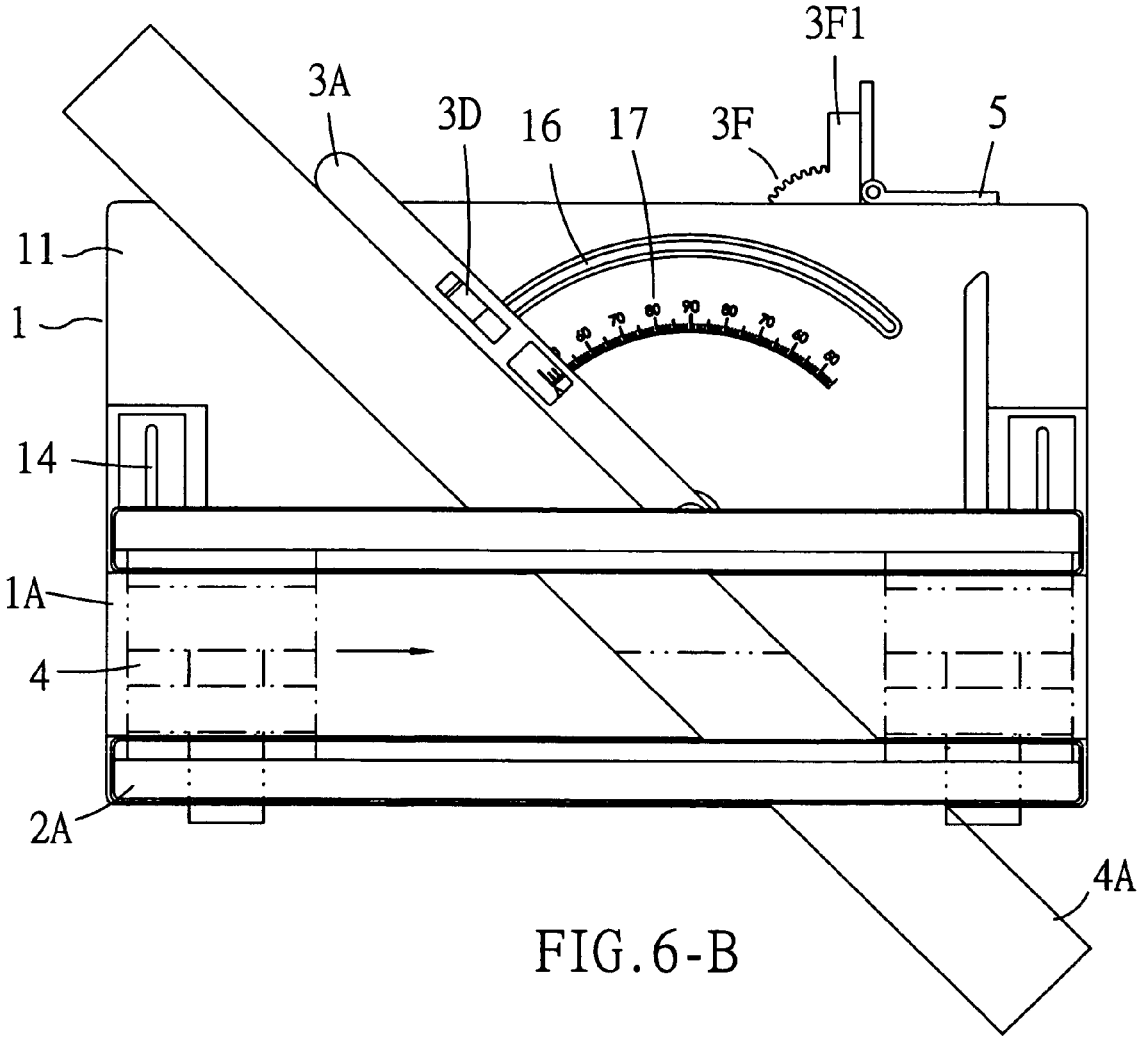
FIG.6-B

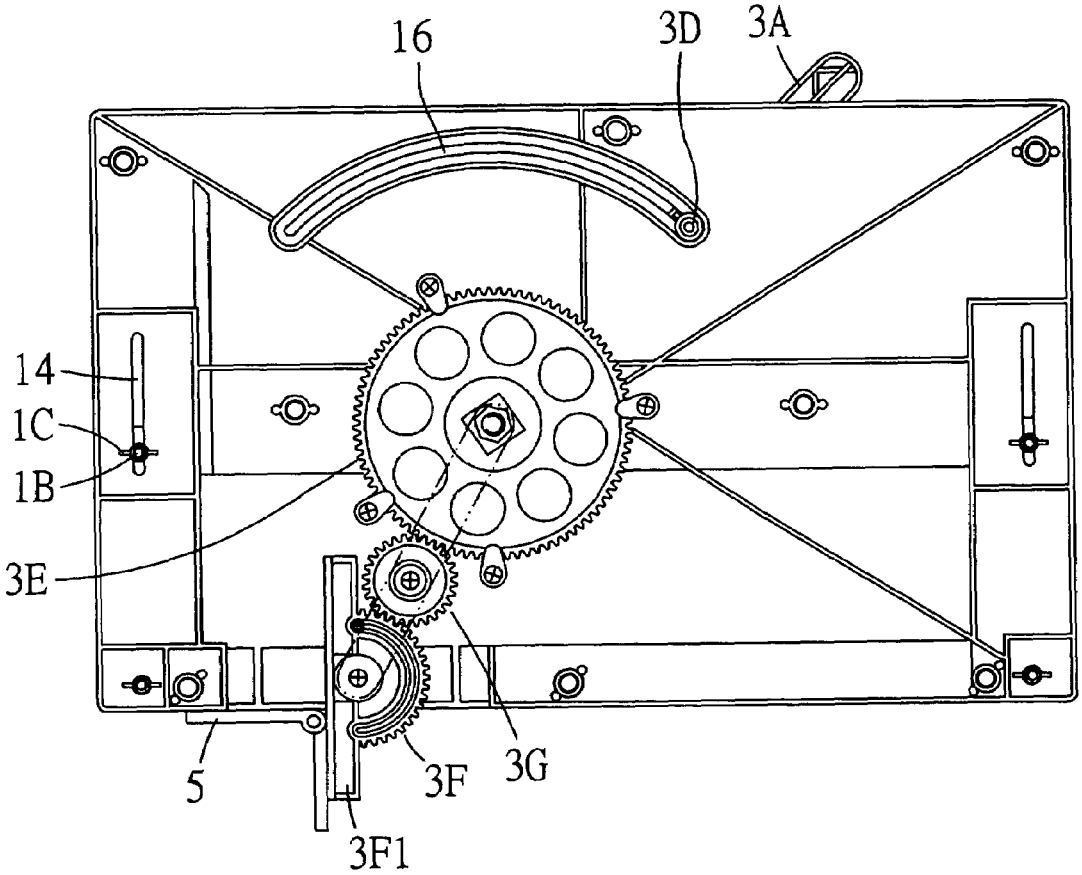
FIG.6-C

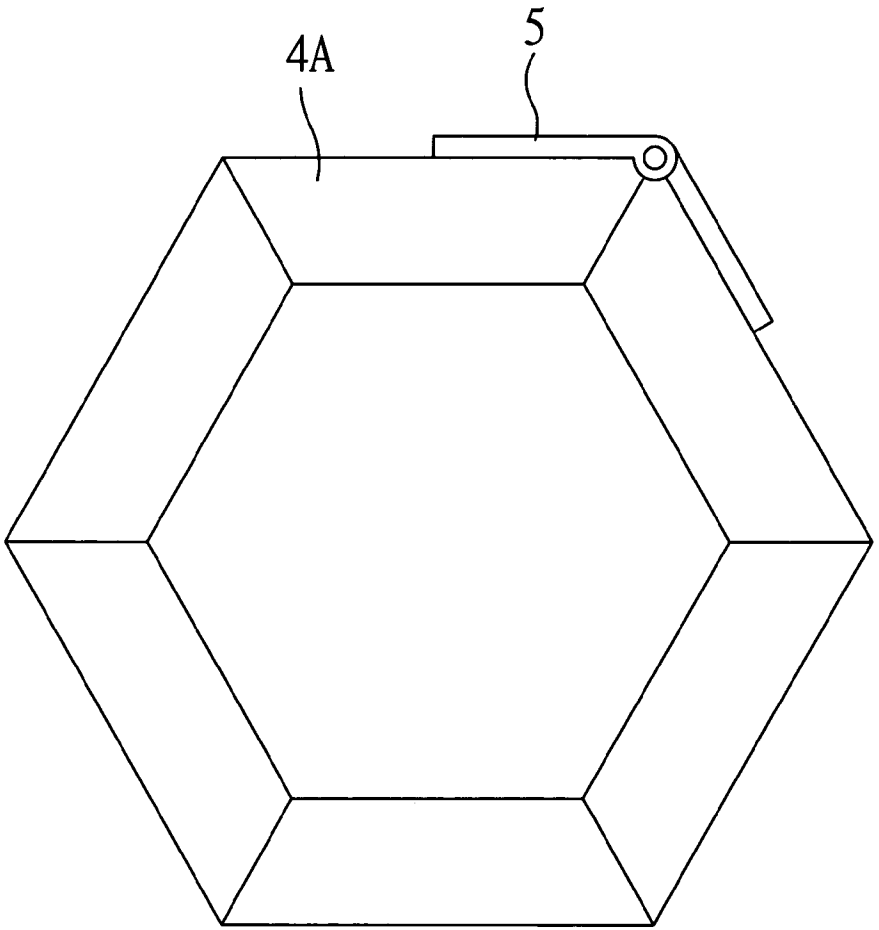
FIG. 7-A

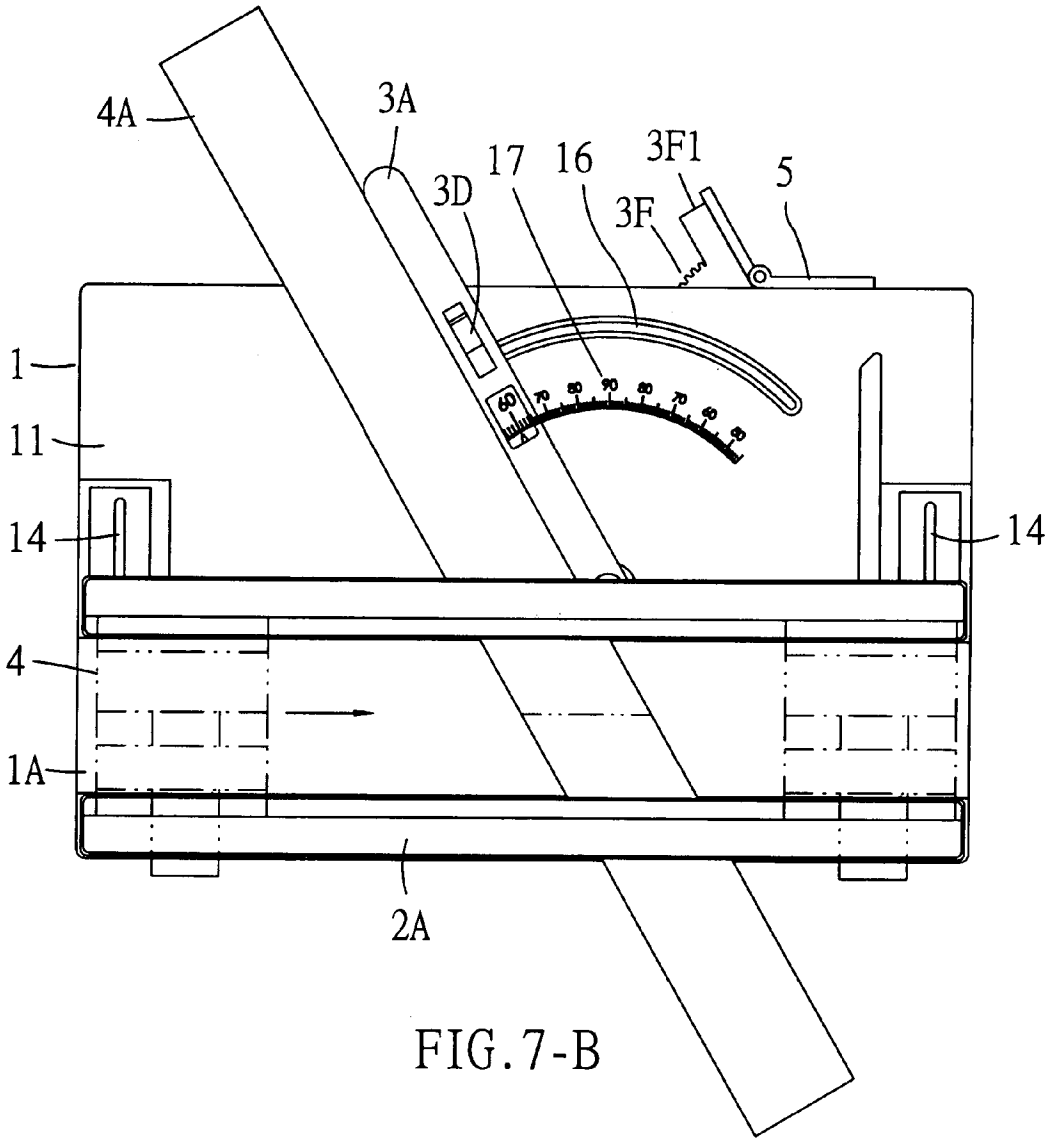
FIG. 7-B

ANGLE ADJUSTABLE SAWING TABLE

BACKGROUND OF THE INVENTION (a) Field of the Invention

The present invention is related to an angle adjustable sawing table, and more particularly, to one that allows direct measurement of geometric angles of wood materials for cutting.

(b) Description of the Prior Art

A sawing table on site is perhaps the most important tool in any decoration job for a carpenter. Usually the table has a foundation comprised of four pieces of boards including two girders and two stretchers with a table inserted on the top and a circular saw below the table.

In the prior art, the board is placed on the table and measured manually for the geometric angle and the finished size to be cut; then the board is marked when the angle is determined, to allow the circular saw to cut the board into the size and angle desired. However, in the absence of any measurement tools designed for the sawing table, all the measurements and geometric angles must be done manually resulting in wasted time, and poor accuracy and efficiency.

SUMMARY OF THE INVENTION

The primary purpose of the present invention is to provide a sawing table that saves the efforts of manual measurement. To achieve the purpose, the present invention is adapted with control and measurement units and allowing adjustment of an angle. The control unit facilitates the installation of a circular saw depending on the size of the circular saw, the thickness and the width of the board. A turning arm of the measurement unit is turned to the location preset for the cutting angle, and the board is placed on the table and flushed against the turning arm, the circular saw traveling on the rectangular rail is led to cut.

BRIEF DESCRIPTION OF THE DRAWINGS

FIG. 1A is a perspective view showing an assembly of a saw table of the present invention.

FIG. 1B is an exploded view of the present invention.

FIG. 1C is a schematic view showing the bottom of a top of the saw table of the present invention.

FIG. 2A is a perspective view showing the appearance of a connection block of a control unit of the present invention.

FIG. 2B is a section view of the connection block of the control unit of the present invention.

FIG. 3A is a schematic view showing the guide rail facing up of the control unit.

FIG. 3B is a schematic view showing the guide rail facing down of the control unit.

FIGS. 4A, 4B, 4C, 4D, 4E, and 4F are side sectional views showing the adjustment of thickness and width of the control unit of the present invention.

FIGS. 4G, 4H, and 4I are front sectional views showing the adjustment of thickness and width of the control unit of the present invention.

FIGS. 5A and 5B are schematic views showing the layout of the control unit before the measurement of the angle by a square.

FIG. 6A is a schematic view showing the angle measurement by the square.

FIGS. 6B and 6C are schematic views showing the adjustment of the turning arm to cut on the saw table after the measurement of the angle by the square.

FIG. 7A is a schematic view showing the measurement of another angle by the square.

FIG. 7B is a schematic view showing the adjustment of the turning arm to cut on the saw table after the measurement of the angle by the square.

DETAILED DESCRIPTION OF THE PREFERRED EMBODIMENTS

Figure 8:
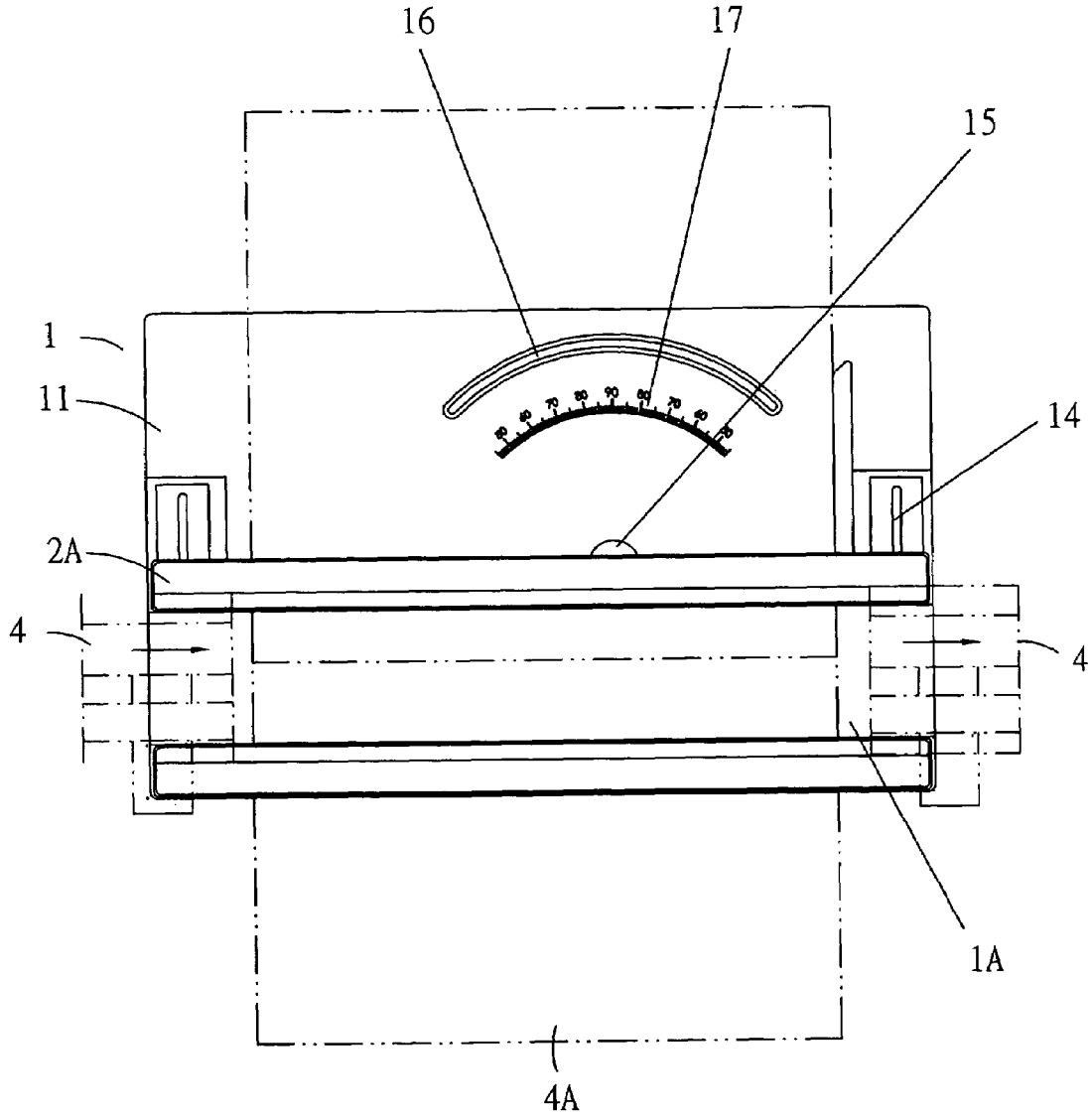
FIG. 8 is a schematic view showing that a circular saw is cutting a board.

Referring to FIGS. 1A, 1B, 1C, 2A, 2B, 3A and 3B, the present invention is essentially comprised of a table 1, a top 11, a control unit 2 and a measurement unit 3.

The table 1 is provided on one side with a longitudinally recessed guide trough 12 to be inserted with a plank 1A in the same size of the guide trough 12, and the plank 1A is secured to the table 1 with multiple screws 1B penetrating from beneath the top 11. As a circular saw 4 is processing on a board 4A, it cuts farthest into the plank 1A without damaging the top 11. Besides, the plank 1A is a consumption item and can be replaced at any time when worn out to a certain extent. Each side of both shorter sides of the guide trough 12 is provided with a positioning hole 13 and a guide rail slot 14 for the assembly and positioning of two pairs of connection blocks 2B from the control unit 2. An axial hole 15 penetrates through the table 1 on one side of the guide trough 12 where the guide rail slot 14 is provided.

The control unit 2, comprised of a pair of guide rails 2A and two pairs of the connection blocks 2B, is provided on the top 11 at the same side where the guide trough 12 is located. One pair of the connection blocks 2B is raised and locked to the positioning holes 13 disposed at both ends on one side of the table 1 using two screws 1B and two winged nuts 1C. Similarly, another pair of the connection blocks 2B is raised and locked to the guide rail slot 14 on the inner side of the table 1 with two screws 1B and two winged nuts 1C. The pair of the connection blocks 2B on the guide rail slot 14 is readily free to reciprocally travel thereon by loosening the winged-nuts 1C. The pair of guide rails 2A is provided striding over the plank 1A by means of those two pairs of the connection blocks 2B erected on the top 11. A chamber 2A1 defined in each end of the pair of the guide rails 2A merely accommodates its respective connection block 2B. A screw hole 2A2 is each provided on both sides of the chamber 2A1, and a multi-sectional adjustment channel 2B1 hollowed in an "E" shape is each provided on both sides of the connection block 2B for the screw 1B and the winged-nut 1C to lock each connection block to the guide rail 2A. Accordingly, the pair of the guide rails 2A is integrated with both pairs of the connection blocks 2B.

The measurement unit 3 is comprised of a turning arm 3A and a gear set. A shaft 3A1 extends from the bottom of the fixed end of the turning arm 3A and passes downward through an axial hole 15 on the top 11 to be pivoted to the gear set disposed beneath the top 11. A square hole 3A3 and a magnifier 3C are provided on the surface 3A2 at a position closer to the free end of the turning arm 3A. The square hole 3A3 is disposed at a position in relation to an arc hole 16 penetrating through the top 11, and a handle 3D is inserted through the square hole 3A3 and the arc hole 16 to lock the turning arm 3A to the top 11 to control turning and positioning of the turning arm 3A for facilitating the adjustment of the cutting angle. A miter gage 17 of the same curve as that of the arc hole 16 is provided on the top 11 over the arc hole 16 for the angle adjustment by the turning arm 3A, and for turning the magnifier 3C provided on the surface 3A2 of the turning arm 3A to magnify the scales of the miter gage 17 to facilitate observation and measurement. The gear set is comprised of a large gear 3E, a medium gear 3F, and a small gear 3G in a specific gear ratio of 1:2. Wherein, the large gear 3E is provided at a position where the axial hole 15 is located below the top 11, and an axial hole 3E1 at the center of the large gear 3E and the shaft 3A1 of the turning arm 3A is inserted into the axial hole 3E1. A screw 3H adapted with a washer penetrates through the turning arm 3A, the axial hole 15 and the large gear 3E, and is secured with a nut and washer, not referenced. The medium gear 3F and the small gear 3G are in sequence secured to where beneath the top 11 with a screw 1B and washers (not referenced) with the small gear 3G located between the large gear 3E and the medium gear 3F to engage to one another to become a synchronous link subsystem. The medium gear 3F indicates a semi-circular shape and is connected on its side not provided with teeth to a rule 3F1 for a square 5. The square 5 is comprised of two rules at a right angle to each other, to be positioned flush against the turning arm to directly calibrate the swinging angle of the turning arm 3A.

The circular saw 4 is provided striding between the pair of guide rails 2A of the control unit 2 to reciprocally travel on the pair of guide rails 2A in a smooth and reliable fashion to help upgrade sawing quality of the finished product of the board 4A. Furthermore, the installation site on the table 1 for the circular saw 4, depending on its size, can be adjusted in conjunction with the pair of guide rails 2A and two pairs of the connection blocks 2B to process the board 4A in different width and thickness.

Now referring to FIGS. 4A, 4B, 4C, 4D, 4E, 4F, 4Q 4H, and 4I, wherein, both ends of each rail rise to be tightly caught in their respective chambers 2A1 upon adjusting the pair of guide rail 2A. Multiple screws 1B and winged nuts 1C secure each connection block 2B into each chamber 2A1 through the screw hole 2A2 and the multi-sectional adjustment channel 2B1. Accordingly, both guide rails 2A stride over and are locked to those two pairs of the connection blocks 2B. Whereas the guide rail slot 14 on the top 11 permits the pair of the connection blocks 2B to reciprocally travel in the guide rail slot 14 by fast loosening and retightening their respective screws 1B and winged nuts 1C, both guide rails 2A move synchronously to have the width between both guide rails 2A adjusted for compromising the specification of the circular saw 4 to be installed on the table 1 depending on the width and thickness of the board 4A placed on the top 11 for cutting.

By fast loosening and retightening those screws 1B and winged nuts 1C that lock up the pair of guide rail 2A to their respective connection blocks 2B, both pairs of the connection blocks 2B are adjusted to permit longitudinal movement of both ends of the pair of guide rails 2A for ascending or descending the circular saw 4 disposed between both guide rails 2A according to the specification of the circular saw 4 until it could handle the thickness of the board 4A. Accordingly, those screws 1B and winged nuts 1C are retightened to hold the circular saw 4 at a proper working height depending on the thickness of the board 4A to be placed on the top 11 for the circular saw 4 to cut.

The cutting angle of the board 4A is directly adjusted by the measurement unit 3 on the top 11 for the circular saw 4 to cut the board 4A into the preset angle. Manual measurement and solving the angle to mark the angle on the board 4A for the circular saw 4 to cut by following the mark as required in the prior art are no longer necessary.

To make the measurement of the angle as illustrated in FIGS. 5A, 5B, 6A, 6B, 6C, 7A, and 7B, one rule of the square 5 is placed on the table 1, and the medium gear 3F is turned until its rule 3F1 is flushed against the other rule of the square 5. Whereas both of the small gear 3G and the large gear 3E are synchronously linked to the medium gear 3F, the turning arm 3A integrated with the large gear 3E with the screw 3H adapted with a washer is also turned to reach the preset angle. The turning arm 3A is secured in position at the preset angle by loosening and retightening the handle 3D pivoted through the square hole 3A3 on the turning arm 3A and the arc hole 16 on the top 11. The board 4A is placed on the top 11 to firmly flush against the turning arm 3A held in position at the preset angle. The circular saw 4 installed on the pair of the guide rails 2A then cuts the board 4A following the preset angle.

Alternatively, the magnifier 3C provided on the surface 3A2 of the turning arm 3A on the top 11 magnifies the miter gage 17 is used to observe the measurement. Once the turning arm 3A is turned to the location pinpointed by the miter gage 17, the handle 3D is loosened and retightened again to hold the turning arm 3A at the location of the miter gage 17 as observed, and the board 4A is placed on the top 11 until it is firmly flushed against the turning arm 3A for the circular saw 4 installed on the pair of the guide rails 2A to cut the board 4A at the preset angle.

Accordingly, the table 1 of the present invention cuts the board 4A without having to do the manual calculation of the geometric angle for the board 4A and avoids the possible inaccuracy in solving the preset angle simply by measuring the geometric angle with the square 5 and directly placing one rule of the square 5 on the table 1 and the other rule flushed against the rule 3F1 of the medium gear 3F to adjust the turning arm 3A to reach at the present angle for the circular saw 4 installed on the pair of the guide rails 2A to cut the board 4A at the preset angle.

As illustrated in FIG. 8, the gear set of the present invention can be comprised of the large gear 3E, the medium gear 3F and a drive belt 3J at the gear ratio of 1:2. Wherein, the large gear 3E is placed at where the axial hole 15 is located beneath the top 11, and the axial hole 3E1 at the center of the large gear 3E is inserted by the shaft 3A1 of the turning arm 3A. The screw 3H adapted with a washer connects the turning arm 3A, the axial hole 15 and the large gear 3E into a one piece. The medium gear 3F is fixed to where beneath the top 11 with the screw 1B, and the drive belt 3J is inserted at where between the large gear 3E and the medium gear 3F to link both gears 3E, 3F for synchronous movement to have the turning arm 3A integrated with the large gear 3E by means of the screw 3H adapted with a washer to arrive at the preset angle. One upholding rod 3I is each provided on both sides of the drive belt 3J disposed between the large and the medium gears 3E, 3F. A head 3I1 of the upholding rod 3I merely contacts the outer edge of the driver belt 3J to prevent the drive belt 3J from falling off its place during the transmission of both the large and the medium gears 3E, 3F as driven by the drive belt 3J.

Figure 9:
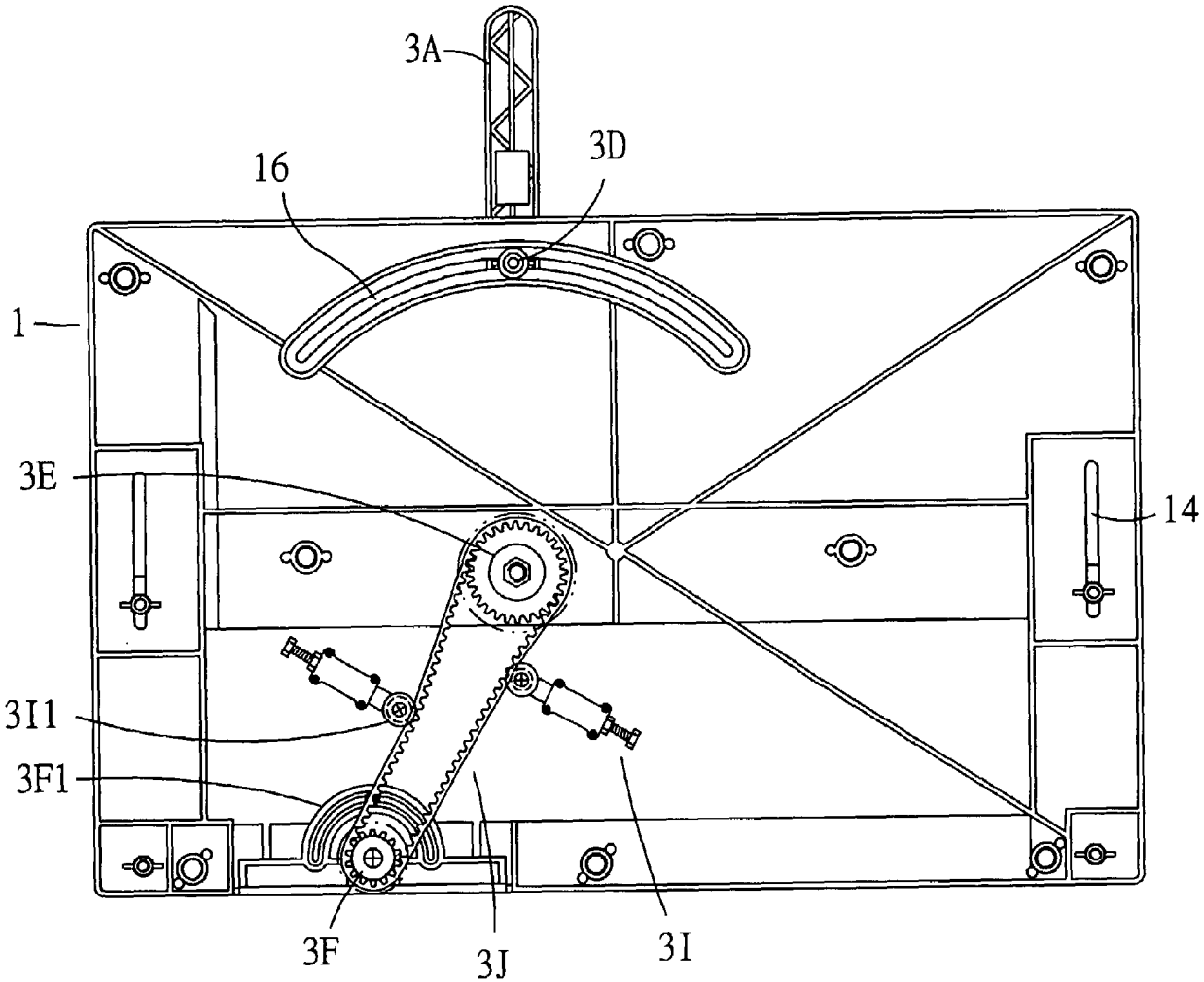
FIG. 9 is a schematic view showing another gear set is adapted to where beneath the saw table of the present invention.

Furthermore, as illustrated in FIG. 9, the board 4A is placed at a right angle on the top 11 of the table 1, and the space on the top 11 is not sufficient for the placement of the board 4A due to the presence of the turning arm 3A of the measurement unit 3 on the top 11. The turning arm 3A of the measurement unit 3 on the top 11 is removed before placing the board 4A on the top 11 at a right angle.

It is to be noted that the preferred embodiments disclosed in the present invention are not used to limit the scope of the present invention, and that any equivalent change and decoration to the form, construction, characteristics and teaching described in the Claims of the present invention shall be deemed as falling within the scope of those Claims.

The invention claimed is:

1. A carpenter saw table, comprising:

a table having opposing positioning holes disposed on one side thereof, each positioning hole being disposed on opposite ends of the table, and having opposing guide rail slots disposed on the opposite ends of the table;

a control unit on the one side of a top of the table, and being comprised of a pair of guide rails and two pairs of connection blocks, the connection blocks of one of the pairs being raised and locked to the respective a positioning holes using screws and winged nuts; the connection blocks of another of the pairs being raised and locked with screws and winged nuts to the respective guide rail slots, and reciprocally traveling along the guide rail slots by loosening of the winged nuts; both guide rails being installed to extend over the top of the table using the two pairs of the connection blocks; a chamber being provided at each respective ends of each guide rail; and each connection block being upwardly and tightly received in a respective chamber and fastened therein using screws and winged nuts; both sides of each connection block being provided with an E shaped multi-sectional adjustment channel that accommodates a respective screw to facilitate the loosening and refastening of the connection blocks to the guide rails, to allow both ends of each guide rail to longitudinally move in relation to their respective connection blocks to accommodate an individual circular saw; and a measurement unit comprised of a turning arm disposed over the top of the table, and a gear set disposed beneath the top of the table; a shaft extending from a bottom of a fixed end of the turning arm and penetrating downwardly through an axial hole formed in the top of the table to be pivoted to the gear set; a square hole being disposed on the turning arm at a position close to a free end of the turning arm in relation to an arc hole penetrating through the top of the table; a pivotal handle disposed on the top of the table, and extending through the square hole and the arc hole to control a positioning of the turning arm for angle adjustment; a miter gage of a same curvature as the arc hole being provided on the top of the table and adjacent to the arc hole to indicate an angle of the turning arm; the gear set being comprised of a large gear, a medium gear, and a small gear at a gear ratio of 1:2, the large gear being secured in the axial hole beneath the top of the table; an axial hole at a center of the large gear being penetrated by the shaft extending from the turning arm, the large gear being connected with the turning arm using a screw; the medium gear and the small gear being screwed in position; the small gear being provided between and engaged with the large and the medium gears; and the large, the medium, and the small gears forming a synchronous link.

2. The carpenter saw table of claim 1, further comprising a magnifier provided on the turning arm to magnify the miter gage for observation and measurement.

3. The carpenter saw table claim 1, wherein, the medium gear has a semi-circular shape with a side not provided with gear teeth having a flat for the placement of a rule that extends from the gear; and a square for angle measurement being positioned flush against the flat to directly calibrate the swinging angle of the turning arm.

4. A carpenter saw table, comprising:

a table having opposing positioning holes disposed on one side thereof, each positioning hole being disposed on opposite ends of the table, and having opposing guide rail slots disposed on the opposite ends of the table;

a control unit on the one side of a top of the table, and being comprised of a pair of guide rails and two pairs of connection blocks, the connection blocks of one of the pairs being raised and locked to the respective a positioning holes using screws and winged nuts; the connection blocks of another of the pairs being raised and locked with screws and winged nuts to the respective guide rail slots, and reciprocally traveling along the guide rail slots by loosening of the winged nuts; both guide rails being installed to extend over the top of the table using the two pairs of the connection blocks; a chamber being provided at each respective end of each guide rail; and each connection block being upwardly and tightly received in a respective chamber and fastened therein using screws and winged nuts; both sides of each connection block being provided with an E shaped multi-sectional adjustment channel that accommodates a respective screw to facilitate the loosening and refastening of the connection blocks to the guide rails, to allow both ends of each guide rail to longitudinally move in relation to their respective connection blocks to accommodate an individual circular saw; and a measurement unit comprised of a turning arm disposed over the top of the table, and a gear set disposed beneath the top of the table; a shaft extending from a bottom of a fixed end of the turning arm and penetrating downwardly through an axial hole formed in the top of the table to be pivoted to the gear set; a square hole being disposed on the turning arm at a position close to a free end of the turning arm in relation to an arc hole penetrating through the top of the table; a pivotal handle disposed on the top of the table, and extending through the square hole and the arc hole to control a positioning of the turning arm for angle adjustment; a miter gage of a same curvature as the arc hole being provided on the top of the table and adjacent to the arc hole to indicate an angle of the turning arm;

wherein, the gear set is comprised of a large gear, a medium gear at a gear ratio of 1:2, and a drive belt; the large gear being provided in the axial hole beneath the top of the table; both of the large and the medium gears being linked by means of the drive belt disposed between both of the large and the medium gears; the turning arm being connected with the large gear using a screw; and upholding rods being each provided on both sides of the drive belt disposed between the large and the medium gears, with a head of the upholding rods contacting an outer edge of the driver belt to prevent it from falling off its place.

* * * * *